US011879221B2

(12) United States Patent
Rapp

(10) Patent No.: US 11,879,221 B2
(45) Date of Patent: Jan. 23, 2024

(54) SNOW TILLER AND METHOD OF ADJUSTING THE SAME

(71) Applicant: Prinoth S.P.A., Vipiteno (IT)

(72) Inventor: Sebastian Rapp, Vipiteno (IT)

(73) Assignee: Prinoth S.P.A., Vipiteno (IT)

( * ) Notice: Subject to any disclaimer, the term of this patent is extended or adjusted under 35 U.S.C. 154(b) by 519 days.

(21) Appl. No.: 16/967,346

(22) PCT Filed: Feb. 22, 2019

(86) PCT No.: PCT/IB2019/051463
§ 371 (c)(1),
(2) Date: Aug. 4, 2020

(87) PCT Pub. No.: WO2019/162900
PCT Pub. Date: Aug. 29, 2019

(65) Prior Publication Data

US 2021/0032825 A1 Feb. 4, 2021

(30) Foreign Application Priority Data

Feb. 23, 2018 (IT) ..... 102018000003000

(51) Int. Cl.
*E01H 4/02* (2006.01)

(52) U.S. Cl.
CPC ..... *E01H 4/02* (2013.01)

(58) Field of Classification Search
CPC ..... E01H 4/02; E01H 4/023; A01B 33/00; A01B 33/08; A01D 34/24; A01D 34/246;
(Continued)

(56) References Cited

U.S. PATENT DOCUMENTS 348,401 A * 8/1886 Lay ..... A01B 33/021 172/116
3,746,101 A 7/1973 Takata
(Continued)

FOREIGN PATENT DOCUMENTS

CN 101918641 A 12/2010
CN 204738206 U 11/2015
(Continued)

OTHER PUBLICATIONS

Office Action and Search Report (with translation) for Chinese Application No. 201910133325.X dated Oct. 25, 2021 (18 pages).
(Continued)

*Primary Examiner* — Adam J Behrens
*Assistant Examiner* — Blake E Scoville
(74) *Attorney, Agent, or Firm* — Neal, Gerber & Eisenberg LLP

(57) ABSTRACT

A snow tiller for grooming the snow cover of ski slopes comprises: a frame, which comprises at least one front attachment configured to connect the snow tiller to a hitch device of the tracked vehicle; at least one tiller module having a shaft, which is rotatable about an axis of rotation and is provided with a plurality of tools configured to penetrate the snow cover, a hood, which is arranged about the shaft, and is supported by the frame, and an adjusting device, which is configured to adjust the position of the shaft with respect to the hood; and a finisher, having a flexible mat, which is configured to compact the snow cover and to define a support zone of the snow tiller on the snow cover.

10 Claims, 4 Drawing Sheets

(58) Field of Classification Search
CPC ..... A01D 34/28; A01D 34/283; A01D 34/03; A01D 34/032; A01D 34/035; A01D 34/54; A01D 34/02
See application file for complete search history.

(56) References Cited

U.S. PATENT DOCUMENTS

| | | | | | |
|---|---|---|---|---|---|
| 5,067,263 | A * | 11/1991 | Pelletier | E01H 4/02 | 37/219 |
| 5,659,984 | A * | 8/1997 | Haug | G01N 33/6857 | 37/219 |
| 5,809,671 | A * | 9/1998 | Sinykin | E01H 4/02 | 37/219 |
| 7,669,395 | B2 * | 3/2010 | Wehler | A01D 34/74 | 56/14.9 |
| 8,646,542 | B2 * | 2/2014 | Nusser | E01H 4/02 | 172/112 |

FOREIGN PATENT DOCUMENTS

| | | | | |
|---|---|---|---|---|
| CN | 204875439 | U | 12/2015 | |
| CN | 106087841 | A | 11/2016 | |
| CN | 106133244 | A | 11/2016 | |
| CN | 106884401 | A | 6/2017 | |
| EP | 0 648 899 | | 4/1995 | |
| EP | 0 674 734 | | 10/1995 | |
| EP | 1 925 746 | | 5/2008 | |
| JP | 2014037686 | A | 2/2014 | |
| RU | 2011138161 | A | 3/2013 | |
| WO | WO2008/114138 | | 9/2008 | |
| WO | WO2009/034185 | | 3/2009 | |
| WO | WO-2009034185 | A1 * | 3/2009 | E01H 4/02 |

OTHER PUBLICATIONS

Notification Concerning Submission, Obtention or Transmittal of Priority Document for International Application No. PCT/IB2019/051463 dated Mar. 18, 2019.

International Search Report and Written Opinion for International Application No. PCT/IB2019/051463 dated Jun. 3, 2019.

* cited by examiner

SNOW TILLER AND METHOD OF ADJUSTING THE SAME

PRIORITY CLAIM

This application is a national stage application of PCT/IB2019/051463, filed on Feb. 22, 2019, which claims the benefit of and priority to Italian Patent Application No. 102018000003000, filed on Feb. 23, 2018, the entire contents of which are each incorporated by reference herein.

TECHNICAL FIELD

The present disclosure relates to a snow tiller for grooming ski slopes.

BACKGROUND

Generally speaking, a snow tiller for grooming ski slopes comprises a frame; a rotating shaft; a plurality of tools fitted to the shaft; a hood arranged about the shaft; and a finisher that, in this case, comprises a flexible mat, which is mounted on the hood and is designed to compact the tilled snow.

The snow tiller is generally drawn over the snow cover by a tracked vehicle in a direction of travel by a drawbar.

The rear end of the snow tiller rests on the snow cover, in this case, the snow tiller rests on the finisher, and the front end supported by the drawbar, which is, in turn, connected to and controlled by the tracked vehicle.

The characteristics of the snow cover, for example the thickness and the mechanical properties of the snow, vary within a relatively very wide range and to prepare a relatively perfect snow cover the working depth of the tools and the dimensions of the snow chamber must be adjusted based on the aforesaid characteristics.

It should be appreciated that the adjustment of the working depth of the tools determines the thickness of the snow cover that is actually tilled, whereas the volume of the snow chamber determines the amount of snow that the tiller works inside the work chamber. The purpose of working the snow inside the snow chamber is to reduce the size of any lumps or solid accumulations of snow.

U.S. Pat. No. 5,067,263, EP Patent No. 648,899, EP Patent No. 674,734 and EP Patent No. 1,925,746 disclose snow tillers with respective adjusting systems which make it possible to adjust various operating parameters of the tiller.

Although these systems have proved their relative effectiveness, in some cases they are relatively excessively complex or, in other cases, the tiller structure is no longer adequate to meet present-day needs.

SUMMARY

The purpose of the present disclosure is to provide a snow tiller that mitigates certain of the drawbacks of certain of the prior art.

In accordance with the present disclosure there is provided a snow tiller configured to groom the snow cover of ski slopes, the snow tiller comprising:

- a frame, which comprises at least one front attachment configured to connect the snow tiller to a hitch device of the tracked vehicle;
- at least one tiller module comprising a shaft, which is rotatable about an axis of rotation and is provided with a plurality of tools configured to penetrate the snow cover; a hood, which is arranged about the shaft, and is supported by the frame; and an adjusting device, which is configured to adjust the position of the shaft with respect to the hood; and
- a finisher, which comprises a flexible mat, which is configured to compact the snow cover to define a support zone of the snow tiller on the snow cover.

In accordance with the present disclosure, it is possible to adjust the working depth of the tiller and the dimensions of the snow chamber.

In particular, the shaft is supported in an articulated manner about a first axis, which is parallel to the axis of rotation of the shaft and is arranged in the front part of the snow tiller with respect to the shaft. In this way, the shaft is drawn by the hood in the direction of travel.

In particular, the adjusting device comprises at least two arms configured to support the shaft at the opposite ends, each arm being hinged to the hood about the first axis and the hood being configured to support the shaft. In other words, the hood is a load bearing structure of the snow tiller so that the relative position of the hood and the shaft can be adjusted simply by shaft support arms hinged to the hood.

In particular, the hood comprises two side walls, on which the arms, which are plate-shaped, are mounted in a sliding manner. The arms are, in part, complementary to the side walls and their overall width is relatively very small. Moreover, each arm is guided at the opposite end of the first axis with respect to the shaft in a relatively simple manner: each plate-shaped arm is provided with a circular sector-shaped groove having the first axis as its center, and mounted on the respective side wall of the hood is a pin engaging the groove. In this way, the arm is particularly stable as the arm is supported at the first axis and at the pin.

In particular, the snow tiller comprises a drive member, which is configured to rotate the shaft about the axis of rotation and is supported by one of said arms.

It should be appreciated that based on the solid assembly of the arms, these are able to support high loads determined by the shaft and by the drive member.

In particular, the adjusting device comprises at least one actuator configured to control the position of the arms and of the shaft with respect to the hood. In this case, there is a single hydraulic cylinder configured to determine the position of the shaft with respect to the hood.

The single hydraulic cylinder is able to control the position of both of the arms owing to the fact that the adjusting device comprises a mechanical transmission that extends between the actuator and the arms. In this case, the mechanical transmission comprises a crank shaft and two rods to connect the crank shaft to the respective arms. The entire mechanical transmission is mounted on the hood and extends outside of the hood. Advantageously, the mechanical transmission does not interfere with the snow chamber defined inside the hood and does not alter its shape.

In particular, the crank shaft is mounted so as to be able to rotate with respect to the hood about a second axis parallel to the first axis.

In accordance with the present disclosure, the finisher comprises a pressure bar, which is arranged on the flexible mat, is connected to the hood, and substantially defines a third axis, about which the frame and the hood can swing to vary the inclination and the work configuration of said snow tiller about said third axis.

In practice, the swinging motion about the third axis defines a second mode of adjustment of the snow tiller. The variation in the inclination of the snow tiller about the third axis alters the working depth of the tools and leaves the dimensions of the snow chamber unchanged. The combination of this latter mode of adjustment and the variation of the position of the shaft with respect to the hood makes it possible to achieve an infinite number of configurations of the snow tiller. In particular, the snow chamber and the working depth are adjusted independently of one another.

A further purpose of the present disclosure is to provide a method for adjusting a snow tiller that mitigates certain of the drawbacks of certain of the prior art.

In accordance with the present disclosure there is provided a method for adjusting a snow tiller as described above, the method comprising the step of adjusting the position of the shaft with respect to the frame and the hood in such a way as to simultaneously change the working depth and the dimensions of the snow chamber.

Moreover, the method consists in varying the inclination of the frame and of the hood about a third axis arranged at the finisher to adjust the working depth and keep the dimensions of the snow chamber unchanged.

The combination of the two modes of adjustment envisaged by the method to which the present disclosure relates enable the working depth and the dimensions of the snow chamber to be adjusted independently of one another.

BRIEF DESCRIPTION OF THE DRAWINGS

Further features and advantages of the present disclosure will become apparent from the following description of a non-limiting embodiment thereof, with reference to the accompanying figures, in which.

DETAILED DESCRIPTION

Figure 1:
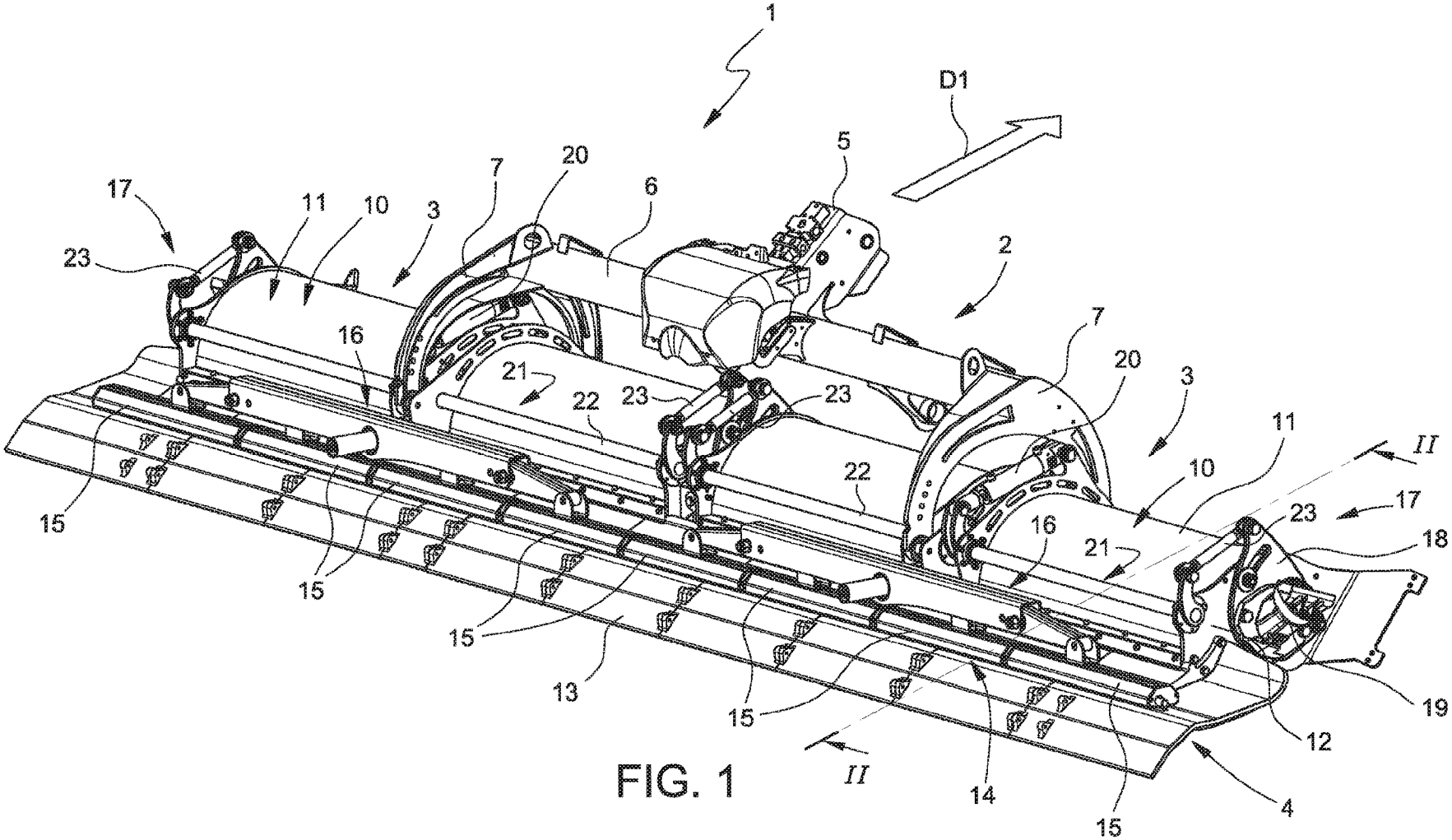
FIG. 1 is a perspective view, with parts removed for the sake of clarity, of a snow tiller in accordance with the present disclosure.

With reference to FIG. 1, denoted as a whole by reference numeral 1 is a snow tiller for grooming ski slopes. The snow tiller 1 is configured to be drawn over the snow cover in a direction of travel D1 by a tracked vehicle (not illustrated in the accompanying figures). The snow tiller 1 is connected by a drawbar (not illustrated in the accompanying figures) to the tracked vehicle (not illustrated).

In the present description, the terms "front", "rear", "front side" and "side" specifically refer to the direction of travel D1 of the snow tiller 1.

The snow tiller 1 mainly extends transverse to the direction of travel D1 and comprises a frame 2; two tiller modules 3 supported by the frame 2 and substantially aligned with respect to a direction transverse to the direction of travel D1; and a finisher 4 supported by the tiller modules 3.

The frame 2 comprises a front attachment 5 configured to be connected to the drawbar (not illustrated in FIG. 1); a cross bar 6; and two forks 7, each of which is configured to support a respective tiller module 3 and to permit a relatively slight swinging motion of the tiller module 3 about an axis parallel to the direction of travel D1 and relative slight displacements of the tiller module 3 with respect to the fork 7.

Each tiller module 3 is suspended in a swinging manner from the respective fork 7 and hinged to the adjacent tiller module 3 so that the tiller is able to adapt to dips in the ground transverse to the direction of travel D1.

Figure 2:
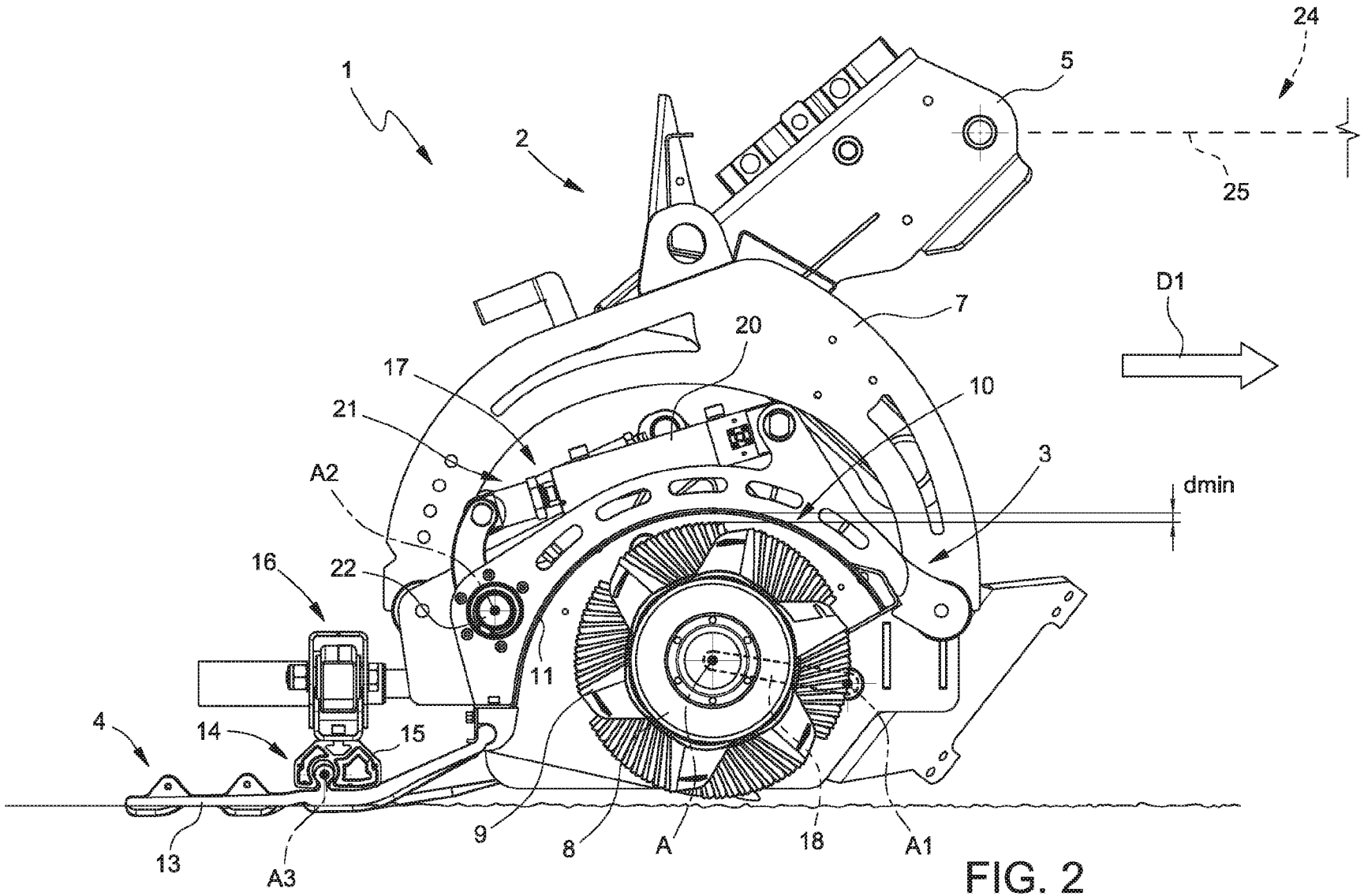
FIGS. 2 to 4 are cross-sectional views, on an enlarged scale and with some parts removed for the sake of clarity, of the tiller of Figure in different operating configurations.

With reference to FIG. 2, each tiller module 3 comprises a shaft 8, which is rotatable about an axis of rotation A that extends in a direction that is substantially transverse to the direction of travel D1 and is provided with a plurality of tools 9 configured to penetrate the snow cover; and a hood 10.

The hood 10 is configured to delimit, with the shaft, a snow chamber, to support the shaft 8 and the finisher 4, and to connect the tiller module 3 to the frame 2.

With reference to FIG. 1, the hood 10 comprises an upper wall 11; and two side walls 12, only one of which is illustrated in the accompanying figures.

With reference to FIG. 2, the hood 10 is also connected to the finisher 4, which comprises a flexible mat 13 connected to the hood 10; and a pressure bar 14, which is arranged on the flexible mat 13 and is connected to the hood 10. The flexible mat 13 is connected to the hood 10 so as to define the continuation of the hood 10, in this case, the continuation of the two hoods 10 of the respective tiller modules 3 as illustrated in FIG. 1.

With reference to FIG. 1, the pressure bar 14 is made up of sectors 15, which are rigid and connected to one another so as to allow a relative slight swinging motion between adjacent sectors 15 and thus adapt the pressure bar 14 and the flexible mat 13 to the waviness of the snow cover. The pressure bar 14 is connected to the hoods 10 by respective articulated mechanisms 16, which are hinged to the tiller modules 3 about respective axes substantially parallel to the direction of travel D1. The articulated mechanisms 16 are configured to transfer the weight of the snow tiller to the pressure bar 14 and enable the pressure bar 14 limited freedom to adapt with respect to the tiller modules 3. In particular, each articulated mechanism is configured to distribute the weight of the snow tiller across a respective group of sectors 15 of the pressure bar 14.

Figure 3:
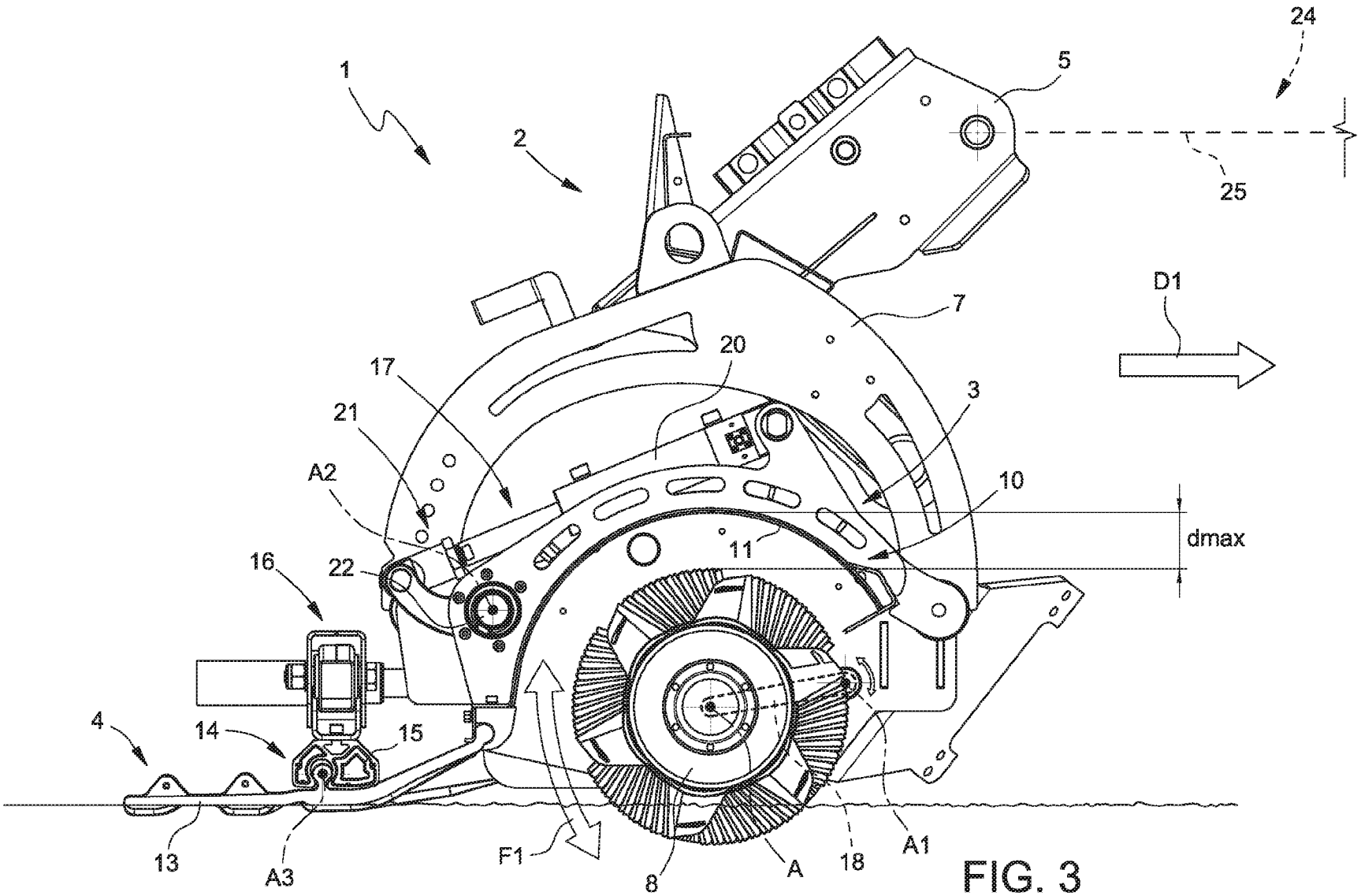
Figure 4:
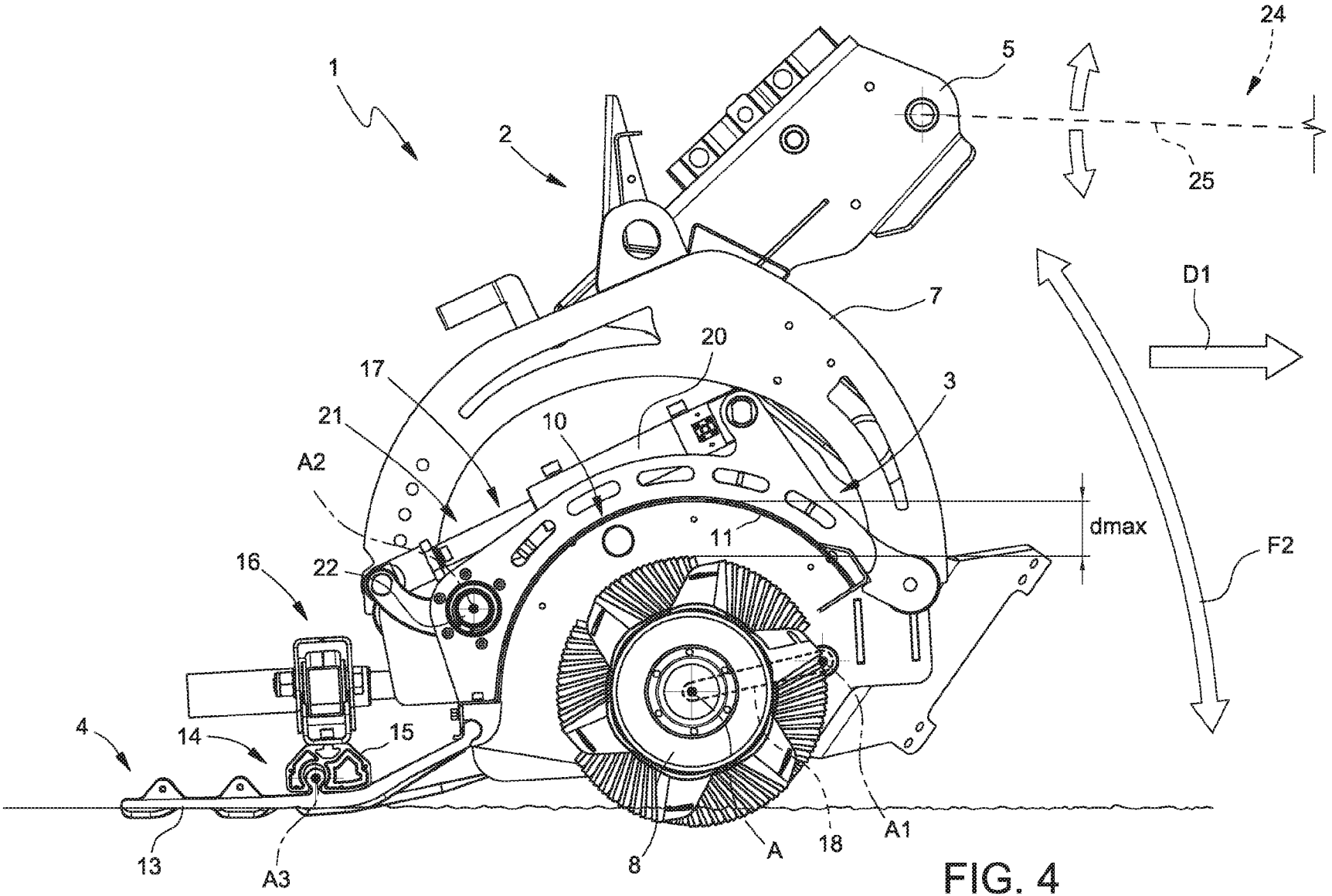

Each tiller module 3 comprises an adjusting system 17, configured to adjust the position of the shaft 8 with respect to the hood 10. In the example that is illustrated, the shaft 8 is supported by the hood 10 in an articulated manner about an axis A1, which is parallel to the axis of rotation A and is arranged in the front part of the tiller 1 with respect to the shaft 8 as illustrated in FIG. 2. In FIGS. 2, 3 and 4, an arm 18 connecting the axis of rotation A of the shaft 8 to the axis A1 is schematically indicated by the dashed line.

In practice, the adjusting device 17 comprises two arms 18 configured to support the shaft 8 at the opposite ends, each of which is hinged to the hood 10 about the axis A1.

In the example that is illustrated in FIG. 1, each of the arms 18 is plate-shaped and mounted in a sliding manner along a respective side wall 12 of the hood 10. Furthermore, in each tiller module 3, one of the plate-shaped arms 18 supports, at the opposite end of the shaft 8, a drive member 19, in this case, a hydraulic motor to rotate the shaft 8 about the axis of rotation A1.

Each plate-shaped arm 18 is guided at the opposite end of the axis A1 with respect to the shaft 8 by a cam/groove coupling configured to support the arm 18 at the opposite end of the axis A1.

The adjusting device 17 comprises at least one actuator 20 configured to control the position of the arms 18 and of the shaft 8 with respect to the hood 10; and a mechanical transmission 21 that extends between the actuator 20 and the shaft 8 of each tiller module 3 and comprises a crank shaft 22; two rods 23 to connect the crank shaft 22 to the respective arms 18; and said arms 18. The crank shaft 22 is mounted so as to be able to rotate with respect to the hood 10 about a second axis A2 parallel to the axis A1.

In use, the snow tiller 1 can assume a plurality of operating configurations. In the operating configuration illustrated in FIG. 2, the tools 9 are raised from the surface of the snow cover and arranged at a minimum distance dmin from the inside surface of the upper part 11 of the hood 10, and the snow tiller 1 is configured to only perform finishing operations using the finisher 4 without tilling.

With reference to FIG. 3, the adjusting system 17 has changed the position of the shaft 8 and of the tools 9 with respect to the other parts of the snow tiller 1 by rotating the arms 18 about the axis A1 in the directions indicated by the arrow F1. In the configuration shown in FIG. 3, the overall position of the snow tiller 1 is identical to that shown in FIG. 2, except for the position of the shaft 8, of the tools 9 and of the adjusting system 17. In accordance with FIG. 3, the tools 9 penetrate the snow by about their full length and the distance of the tools 9 from the surface of the curved wall 11 of the hood 10 is a distance dmax. The adjusting device 17 can place the shaft 8 in a plurality of intermediate positions with respect to those illustrated in FIGS. 2 and 3 while maintaining the hood 10 in the same position.

The snow tiller 1 envisages a further mode of adjustment that consists in altering the inclination of the frame 2 and of the hood 10 about the pressure bar 14 and about a hypothetical axis A3 arranged at the pressure bar 14 in accordance with that illustrated in FIG. 4.

The pressure bar 14 defines the support zone of the snow tiller 1 on the snow cover. Raising and lowering the front attachment 5, within a designated or given range, varies the inclination of the snow tiller 1 about the pressure bar 14 and, as a consequence, varies the working depth of the tools 9 while maintaining the same distance between the ends of the tools 9 and the inside surface of the wall 11 of the hood 10. In the example that is illustrated in FIG. 4, the tools only penetrate the snow cover a little, while the space between the tools 9 and the wall 11 of the hood 10 is equal to dmax as in FIG. 3.

With reference to FIGS. 2 to 4, lowering and raising the snow tiller 1 with respect to the snow cover is achieved by a hitch device 24, which is configured to connect the tracked vehicle (not illustrated in the accompanying figures) to the snow tiller 1 and is driven by a motor, in this case, to raise the front attachment 5 of the snow tiller 1 with respect to the snow cover.

The hitch device 24 comprises a beam 25, which is hinged to the front attachment 5 of the snow tiller 1 and is actuated to raise and lower the position of the front attachment 5. The hitch device 24 comprises a mechanism (not illustrated) to control the relative rotation between the beam 25 and the front attachment 5 and possibly to block the relative rotation between the beam 25 and the front attachment 5.

It is clear that variations may be made to the present disclosure without departing from the scope thereof as set forth in the appended claims. Accordingly, various changes and modifications to the presently disclosed embodiments will be apparent to those skilled in the art.

The invention claimed is:

1. A snow tiller comprising:

a frame comprising a front attachment configured to connect the snow tiller to a hitch device of a tracked vehicle;

a tiller module comprising:

a shaft rotatable about an axis of rotation, coupled with a plurality of tools configured to penetrate a snow cover, and articulately supported about a first axis which is parallel to the axis of rotation of the shaft and arranged in a front part of the snow tiller with respect to the shaft;

a hood arranged about the shaft, supported by the frame and configured to support the shaft, the hood comprising two side walls; and an adjusting device configured to adjust a position of the shaft with respect to the hood, the adjusting device comprising at least two plate-shaped arms configured to support the shaft at opposite ends of the shaft, each plate-shaped arm being hinged to the hood about the first axis, each plate-shaped-shaped arm being mounted directly against an outer face of a respective side wall of the hood, and each plate-shaped arm being configured to slide along the respective side wall of the hood to a plurality of different positions; and a finisher comprising a flexible mat configured to compact the snow cover and which is configured to define a support zone of the snow tiller on the snow cover.

2. The snow tiller of claim 1, wherein each plate-shaped arm is guided at an opposite end of the first axis with respect to the shaft by a cam/groove coupling configured to support the respective plate-shaped arm.

3. The snow tiller of claim 1, further comprising a drive member configured to rotate the shaft about the axis of rotation, wherein one of the at least two plate-shaped arms supports the drive member.

4. The snow tiller of claim 1, wherein the adjusting device comprises an actuator configured to control the position of the shaft with respect to the hood.

5. The snow tiller of claim 4, wherein the adjusting device comprises a mechanical transmission between the actuator and the shaft.

6. The snow tiller of claim 5, wherein the mechanical transmission comprises a crank shaft, and for each of the at least two plate-shaped arms of the adjusting device, two rods to connect the crank shaft to that plate-shaped arm.

7. The snow tiller of claim 6, wherein the crank shaft is rotatably mounted with respect to the hood about a second axis parallel to the first axis.

8. The snow tiller of claim 1, wherein the finisher comprises a pressure bar arranged on the flexible mat, the pressure bar being connected to the hood and defining a second axis about which the frame and the hood vary an inclination and a work configuration.

9. A method for adjusting a snow tiller comprising a frame, a tiller module, and a finisher, the method comprising:

adjusting a position of a shaft of the tiller module of the snow tiller with respect to the frame of the snow tiller and a hood of the tiller module of the snow tiller, wherein:

the shaft is rotatable about an axis of rotation and coupled with a plurality of tools configured to penetrate a snow cover, the hood comprises two side walls, is arranged about the shaft, is supported by the frame, supports the shaft, and is connected to the shaft by at least two plate-shaped arms that are each mounted directly against an outer face of a respective side wall of the hood and are each configured to slide along the respective side wall of the hood to a plurality of different positions, and the finisher comprising a flexible mat configured to compact the snow cover and configured to define a support zone of the snow tiller on the snow cover; and varying an inclination of the frame and the hood about an axis arranged at the finisher.

10. A snow tiller comprising:

a frame comprising a front attachment configured to connect the snow tiller to a hitch device of a tracked vehicle;

a tiller module comprising:

a shaft rotatable about an axis of rotation, coupled with a plurality of tools configured to penetrate a snow cover, and articulately supported about a first axis which is parallel to the axis of rotation of the shaft and arranged in a front part of the snow tiller with respect to the shaft;

a hood arranged about the shaft, supported by the frame and configured to support the shaft, the hood comprising two side walls; and an adjusting device comprising:

an actuator configured to control a position of the shaft with respect to the hood, a mechanical transmission between the actuator and the shaft, a crank shaft, at least two plate-shaped arms configured to support the shaft at opposite ends of the shaft, each plate-shaped arm being hinged to the hood about the first axis and each plate-shaped and each plate-shaped arm being slideably mounted along a respective side wall of the hood, and for each of the at least two plate-shaped arms, two rods to connect the crank shaft to that plate-shaped arm, wherein the crank shaft is rotatably mounted with respect to the hood about a second axis parallel to the first axis; and a finisher comprising a flexible mat configured to compact the snow cover and which is configured to define a support zone of the snow tiller on the snow cover.

* * * * *